US006901617B2

(12) United States Patent
Sprouse, II et al.

(10) Patent No.: US 6,901,617 B2
(45) Date of Patent: Jun. 7, 2005

(54) MULTI-LAYER CUSHION AND COVER

(75) Inventors: Anthony Eric Sprouse, II, Belleville, IL (US); David Kenneth Parsons, Belleville, IL (US)

(73) Assignee: Roho, Inc., Belleville, IL (US)

( * ) Notice: Subject to any disclaimer, the term of this patent is extended or adjusted under 35 U.S.C. 154(b) by 0 days.

(21) Appl. No.: 10/425,726

(22) Filed: Apr. 29, 2003

(65) Prior Publication Data

US 2003/0205920 A1 Nov. 6, 2003

Related U.S. Application Data

(60) Provisional application No. 60/417,338, filed on Oct. 9, 2002, and provisional application No. 60/378,236, filed on May 6, 2002.

(51) Int. Cl.[7] ..... A47C 27/18; A47C 7/02

(52) U.S. Cl. ..... 5/654; 5/653; 5/655.3; 297/452.41; 297/284.1; 297/219.1

(58) Field of Search ..... 5/654, 653, 655.3, 5/706, 710, 713, 737, 738, 644, 645, 490, 925, 926; 297/219.1, 284.1, 452.21, 452.25, 452.26, 452.41, DIG. 1, DIG. 3

(56) References Cited

U.S. PATENT DOCUMENTS

| | | | |
|---|---|---|---|
| 658,789 | A | 10/1900 | Legg |
| 2,800,165 | A | 7/1957 | Talalay et al. |
| 2,970,638 | A | 2/1961 | Halter |
| 3,258,791 | A | 7/1966 | Kaplan |
| 3,376,070 | A | 4/1968 | Johnson |
| 3,468,311 | A | 9/1969 | Gallagher |
| 3,605,145 | A | 9/1971 | Graebe |
| 3,822,425 | A | 7/1974 | Scales |
| 4,005,236 | A | 1/1977 | Graebe |
| 4,076,872 | A | 2/1978 | Lewicki et al. |
| 4,164,798 | A | 8/1979 | Weber |
| 4,234,228 | A | 11/1980 | Flamm |
| 4,279,044 | A | 7/1981 | Douglas |
| 4,399,574 | A | 8/1983 | Shuman |
| 4,424,599 | A | 1/1984 | Hannouche |
| 4,485,505 | A | 12/1984 | Paul |
| 4,541,136 | A | 9/1985 | Graebe |
| 4,605,582 | A | 8/1986 | Sias et al. |
| 4,614,000 | A | 9/1986 | Mayer |
| 4,643,481 | A | 2/1987 | Saloff et al. |
| 4,673,605 | A | 6/1987 | Sias et al. |
| 4,682,818 | A | 7/1987 | Morell |
| 4,698,864 | A | 10/1987 | Graebe |

(Continued)

FOREIGN PATENT DOCUMENTS

| | | |
|---|---|---|
| FR | 1030500 | 1/1951 |
| GB | 921098 | 3/1963 |
| GB | 1310373 | 3/1973 |

OTHER PUBLICATIONS

Roho International, Inc.; The ROHO TRI–MAX; The Seating System for the Active Individual; 1 pg.

*Primary Examiner*—Robert G. Santos
(74) *Attorney, Agent, or Firm*—Polster, Lieder, Woodruff & Lucchesi, L.C.

(57) ABSTRACT

A multi-layer cushion having a shaped base on which is positioned a resilient, cushioning layer. The shaped base is constructed from a supportive foam and has front and lateral bolsters. The cushioning layer is an inflatable air cell cushion having a flexible base and an array of individual air cells arranged in rows across the flexible base. Rows of cells around the perimeter of the air cell cushion are configured to provide comfortable transition areas between the bolsters and the air cell cushion. The cushion includes a cover that has a lower compartment for the foam base and an upper compartment for the air cell layer. The cover functions to keep the air cell layer in place on the foam layer.

42 Claims, 5 Drawing Sheets

U.S. PATENT DOCUMENTS

D294,212 S 2/1988 Sias et al.
4,726,624 A 2/1988 Jay
4,730,610 A 3/1988 Graebe
4,741,057 A 5/1988 Rosier et al.
4,744,351 A 5/1988 Grundei et al.
4,753,480 A 6/1988 Morell
4,788,730 A * 12/1988 Bexton ..... 5/676
4,796,948 A 1/1989 Paul et al.
4,809,374 A 3/1989 Saviez
4,824,169 A 4/1989 Jarrell
4,847,933 A 7/1989 Bedford
4,866,800 A 9/1989 Bedford
4,893,873 A 1/1990 Iwamoto et al.
4,953,913 A 9/1990 Graebe
4,969,223 A 11/1990 Yamaguchi
5,018,790 A 5/1991 Jay
5,052,068 A 10/1991 Graebe
5,079,790 A 1/1992 Pouch
5,111,544 A * 5/1992 Graebe ..... 5/654
5,152,023 A 10/1992 Graebe
5,153,956 A 10/1992 Nold
5,163,737 A 11/1992 Navach et al.
5,176,424 A 1/1993 Tobita et al.
D335,235 S 5/1993 Hildreth
D341,509 S * 11/1993 Evans ..... D6/502
D342,411 S 12/1993 Graebe
5,317,773 A 6/1994 Graebe
5,333,921 A 8/1994 Dinsmoor, III
5,352,023 A 10/1994 Jay et al.
5,369,828 A 12/1994 Graebe
5,378,045 A 1/1995 Siekman et al.
5,379,471 A 1/1995 Holdredge
5,395,162 A 3/1995 Jay et al.
5,444,881 A 8/1995 Landi et al.
5,461,741 A 10/1995 Graebe
D367,199 S 2/1996 Graebe
5,533,220 A 7/1996 Sebag et al.
5,551,107 A 9/1996 Graebe
5,561,875 A 10/1996 Graebe
5,596,781 A 1/1997 Graebe
5,613,257 A 3/1997 Graebe
5,617,595 A * 4/1997 Landi et al. ..... 5/653
5,636,395 A * 6/1997 Serda ..... 5/691
5,645,314 A 7/1997 Liou
D386,035 S 11/1997 Matsler et al.
5,687,438 A 11/1997 Biggie et al.
5,701,621 A * 12/1997 Landi et al. ..... 5/691
D388,651 S 1/1998 Graebe et al.
D389,692 S 1/1998 Graebe et al.
D389,702 S 1/1998 Graebe et al.
D391,110 S 2/1998 Graebe et al.
D391,111 S 2/1998 Graebe et al.
D394,366 S 5/1998 Graebe et al.
5,749,111 A * 5/1998 Pearce ..... 5/652
5,839,140 A 11/1998 Wilkerson
5,845,352 A 12/1998 Matsler et al.
6,018,832 A 2/2000 Graebe
6,026,527 A * 2/2000 Pearce ..... 5/654
6,161,238 A 12/2000 Graebe
D439,098 S 3/2001 Matsler et al.
6,256,819 B1 * 7/2001 Maier et al. ..... 5/653
6,317,912 B1 * 11/2001 Graebe et al. ..... 5/710
6,487,739 B1 * 12/2002 Harker ..... 5/726
6,502,263 B1 * 1/2003 Rowley et al. ..... 5/654
6,578,218 B2 * 6/2003 Wassilefsky ..... 5/648
6,623,080 B2 * 9/2003 Clapper ..... 297/452.41
6,687,937 B2 * 2/2004 Harker ..... 5/726
2002/0088057 A1 * 7/2002 Wassilefsky ..... 5/648
2002/0129449 A1 * 9/2002 Harker ..... 5/726
2003/0205920 A1 * 11/2003 Sprouse et al. ..... 297/219.1
2004/0160112 A1 * 8/2004 Clapper ..... 297/452.41
2004/0237203 A1 * 12/2004 Romano et al. ..... 5/713

* cited by examiner

MULTI-LAYER CUSHION AND COVER

CROSS-REFERENCE TO RELATED APPLICATIONS

This application claims priority provisional application Ser. No. 60/378,236 filed May 6, 2002 and to provisional application Ser. No. 60/417,338, filed Oct. 9, 2002.

BACKGROUND OF THE INVENTION

This invention relates to orthopedic cushions in general, and more specifically to orthopedic wheelchair or other chair or seat cushions.

A well-recognized problem for individuals who are forced to spend extended time seated in wheelchairs or other chairs or seats is the risk of incurring tissue damage, and ultimately the development of decubitus ulcers, at those points on the body that are subject to constant pressure. Decubitus ulcers expose an individual to the risks of infection and irreversible tissue damage, and in any case are difficult to treat. For wheelchair-bound persons, such ulcers typically develop over the bony prominences exposed to pressure while the person is seated, such as the ischia (bony prominences of the buttocks) and the trochanter. Another problem for such individuals is a lack of stability accompanied by a sense of physical insecurity while seated in a wheelchair, and particularly while being moved about in a wheelchair.

There are known to the art, wheelchair cushions that attempt to address these problems by reducing pressure on restricted areas of tissue over bony prominences and redistributing pressure more uniformly over a larger surface area of the buttocks and back of the thighs. Such cushions may include cushions having shaped foam bases and with a cushioning layer on the base. However, a continuing problem for the cushion user is a sense of discomfort, particularly in the trochanter region, due to a transition between the cushioning layer and the base. The transition typically feels like a bump or ridge beneath the upper thighs and, while it does not usually cause tissue damage, is a constant source of discomfort and annoyance to the user. A need therefore exists for a wheelchair or other seat or chair cushion that adequately relieves pressure on pressure points in the regions of the ischia and trochanter, provides the user a sense of stability and security, while at the same time reduces or eliminates the discomfort and annoyance associated with the transition between components of the base.

BRIEF SUMMARY OF THE INVENTION

In an exemplary embodiment, a multi-layer cushion includes a shaped orthotic base, which may be foam or other acceptable material, on which is disposed a cushion layer of interconnected air cells in an array projecting upwardly from the base, wherein the air cells are not uniform in size and shape across the entire array but instead are modified in size and shape along edges of the air cell layer that are adjacent to upwardly projecting portions of the foam base, so that the tops of the air cells are approximately equal in height to the tops of the upwardly projecting portions of the foam. The modified array with air cells of varying size and shape in certain regions adjacent to upwardly projecting portions of the foam reduce the discomfort and annoyance associated with the user's sensation of what would otherwise be an abrupt, uncomfortable transition between the air cells and the foam base. The cushion includes a cover with a lower compartment for the foam base and an upper compartment for the air cell layer. The cover functions to keep the air cell layer properly in place on the foam layer.

DETAILED DESCRIPTION OF THE INVENTION

Figure 1:
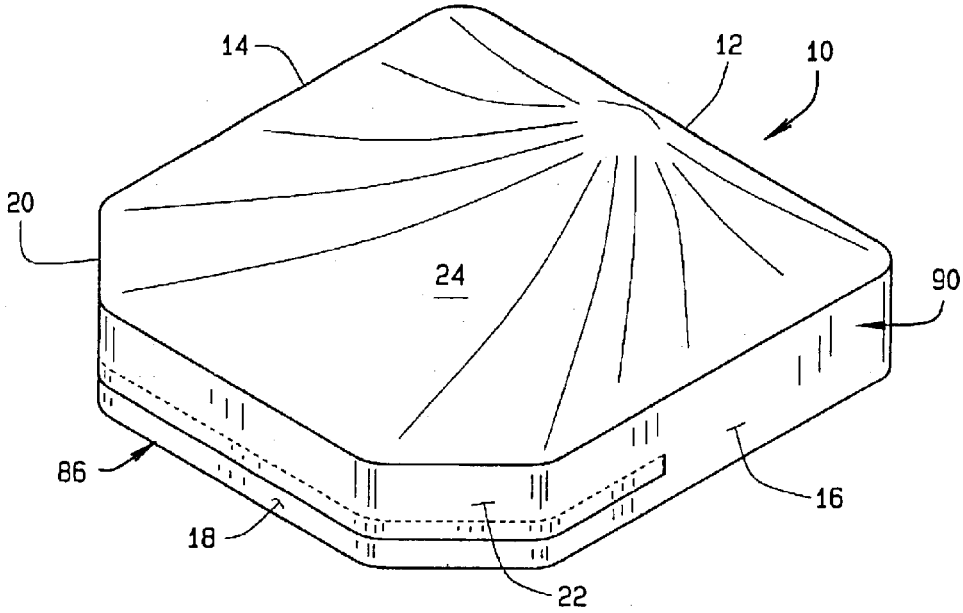
FIG. 1 is a perspective view of the multi-layer cushion of the present invention enclosed in a cover.
Figure 2:
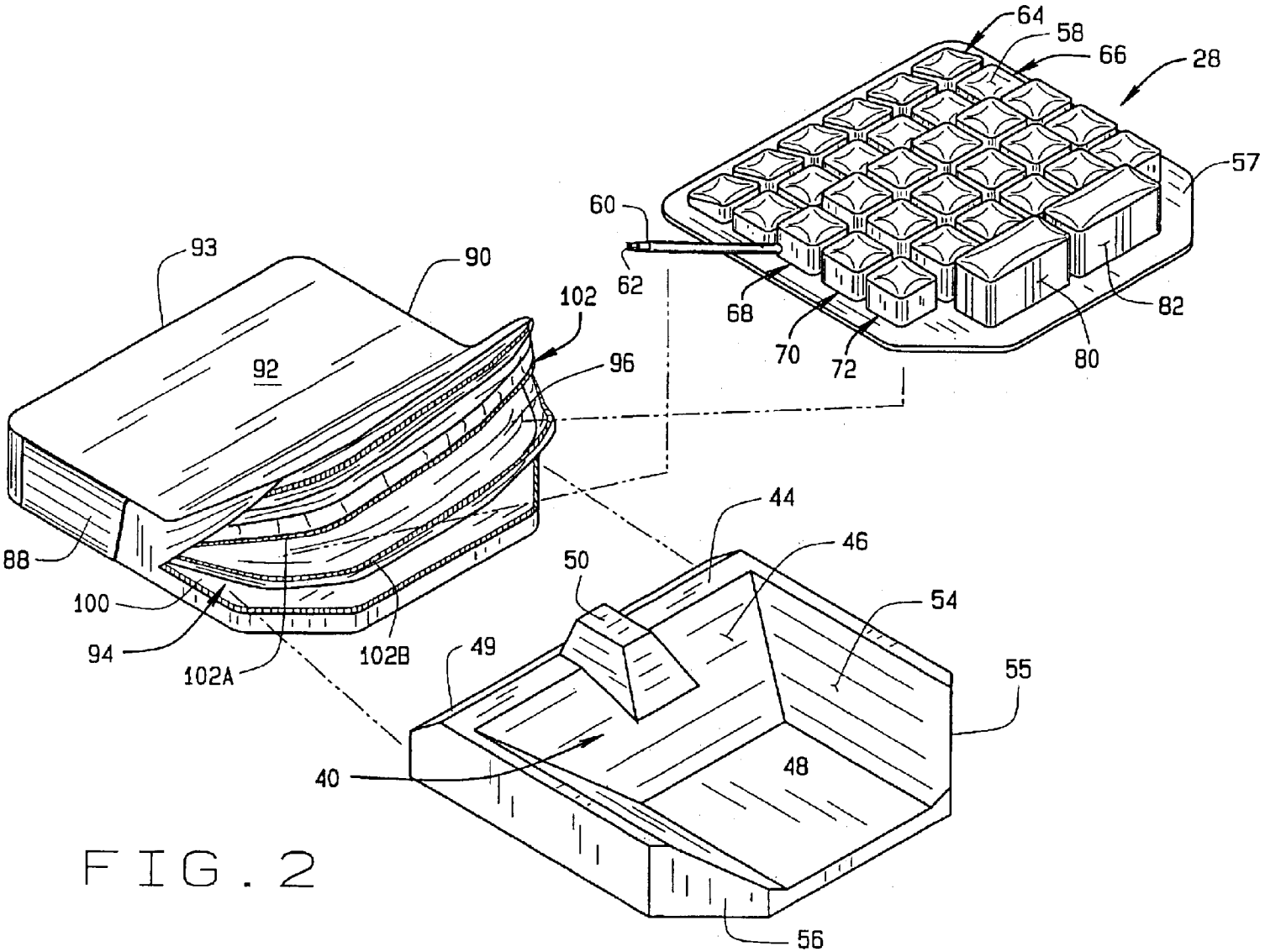
FIG. 2 is an exploded view of the cushion.
Figure 4:
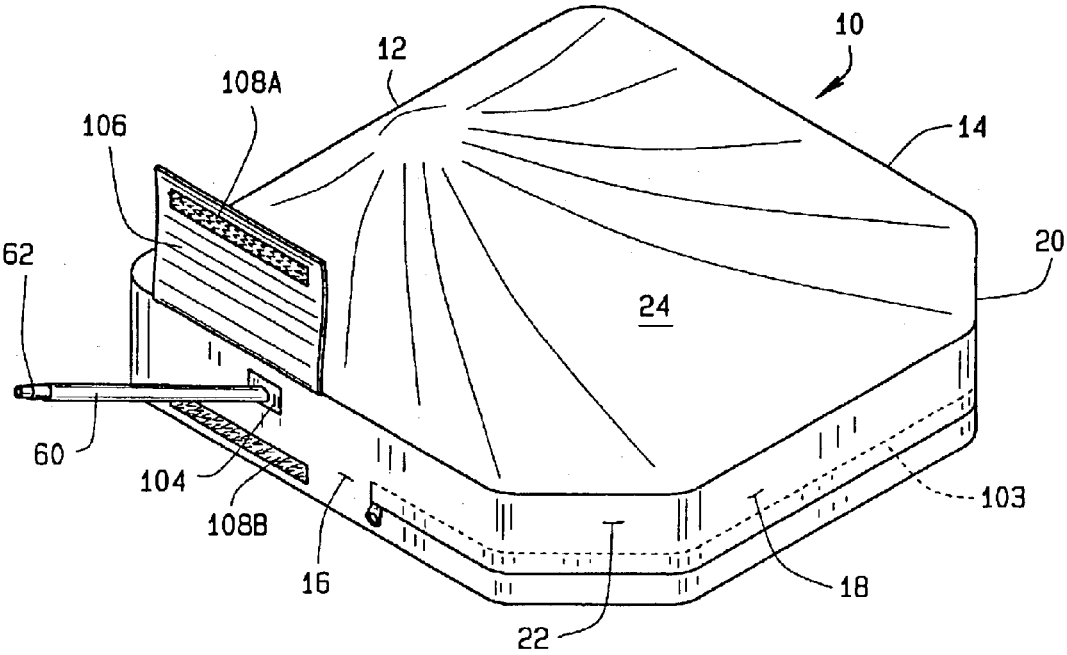
FIG. 4 is a rear perspective view of the assembled cushion with the filler tube cover open.

One preferred embodiment of the cushion and cover assembled and ready for placement on a support surface is indicated generally by reference number 10 in FIG. 1. As can be seen, the preferred embodiment of cushion 10 has a generally rectangular configuration having a front edge 12, a side edge 14 and opposed side edge 16 and a rear edge 18 with truncated corners 20 and 22 between the rear edge 18 and the two side edges 14 and 16, respectively. The truncated corners facilitate positioning of cushion 10 on a support surface (not shown), such as a seat of a wheelchair or conventional chair, as will be understood. Cushion 10, when assembled, has a seating surface to accommodate the buttocks of a user, indicated generally by reference numeral 24. It will be appreciated that the cushion of the present invention can have other configurations dictated by the environment in which it is employed, without departing from the scope of the invention FIG. 2 illustrates the arrangement of the major components of cushion 10. The cushion comprises a supportive orthotic base 26, an air cell layer 28 on top of the base and a compartmentalized cover 30, which maintains air cell layer 28 and base 26 in proper position an alignment when assembled, as well as performing the typical functions one skilled in the art associates with a cover.

In a preferred embodiment, base 26 is a foam base, shown in FIGS. 2 and 7 through 10, has a front edge 32, a first side edge 34 a second side edge 36, a rear edge 38, top seating area 40 and a generally flat bottom surface 42. Base 26 is contoured and is dimensioned to accommodate a range of buttocks sizes. Bolsters placed along the front and side edges generally form the contour of base 26. Front bolster 44 is positioned along the front of the base. Bolster 44 is substantially wedge-shaped and has a relatively greater thickness towards the front edge and includes a sloping support surface 46 that is angled toward a substantially flat mid-portion support surface 48 of the base.

Bolster 44 includes a facing edge 49 that is angled downwardly toward the front edge of the base. Bolster 44 with its angled support surface 46 provides raised but gently sloping support beneath the thighs while the lower plateau in the portion of the cushion that bears the greatest weight, i.e. surface 48, to accommodate the human buttocks shape. The angled facing edge 49 provides a more comfortable surface for the user's thighs and, with cells of the inflatable cushion 28, forms a transition zone to enhance comfort. There is a pommel 50 on the front bolster to fit between the user's thighs and separate and angle the legs in a comfortable position and to stabilize the user's pelvis.

Figure 9:
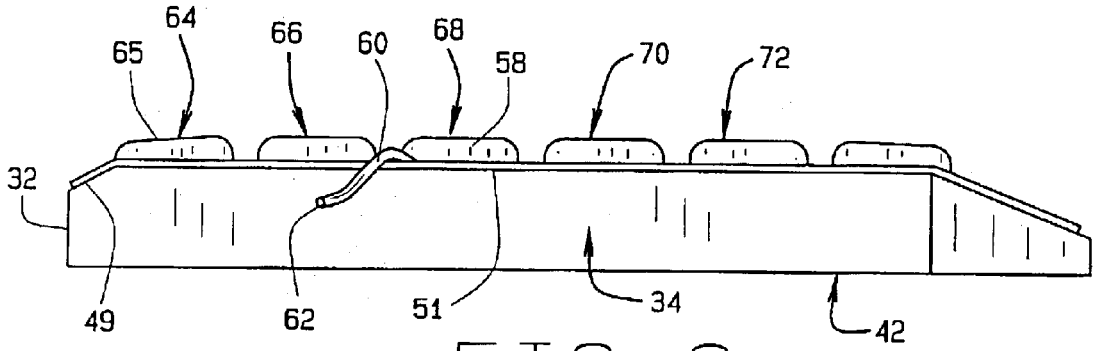
FIG. 9 is a side elevational view of the air cell layer positioned directly on the foam base.

A first lateral bolster 51 is positioned along edge 34 and a second lateral bolster 52 is positioned atop and along edge 36. The lateral bolsters positioned along the side edges provide support at the sides of the cushion to conform to the shape of the human buttocks and provide lateral stability. Lateral bolsters 51 and 52 are mirror images. Each is substantially wedge-shaped and has an interior support surface 54 that slopes downwardly and inwardly toward support surface 48. Each lateral bolster extends nearly the entire length of the side as shown in FIG. 9, and form lateral support for the thighs and provide proper thigh loading characteristics without placing too much pressure on the thighs.

In an exemplary embodiment, base 26 is formed from urethane foam. Sections of the base can be formed from foam of varying firmness. For example, the main section of the foam base, including support area 48, has relatively firmer foam in the mid portion and the lateral bolsters and relatively softer foam beneath the thighs. The base can be molded or formed from one piece of material or the various sections, for example the bolsters, can be formed separately and attached, glued or bonded together to form base 26. Although preferably formed from foam material, base 26 can be formed or molded from other materials, depending upon the support characteristics desired, such as gel, molded plastic, fiberglass or even wood, without departing from the scope of the invention.

The rear edge of base 26 in the illustrated embodiment has truncated corners 55, 56, shaped to fit into the curve of a wheelchair backrest, as explained above in reference to FIG. 1. The dimensions of the foam cushion are adapted to accommodate a variety of human body sizes, and the foam contours are adaptable to fit a large proportion of users of a particular cushion size.

The cushion includes a shock-absorbing layer, which, in a preferred embodiment is an air cell layer 28. Air cell layer 28 is comprised of an inflatable air cell cushion having flexible base 57 with individual air-filled cells 58 in an array. Generally, the cells 58 are parallel to each other and arranged on the base 56 in an array comprised of transverse and longitudinal rows of cells. The air cells 58 are fabricated from a resiliently flexible inflatable material such as neoprene, plastic or the like. The air cell layer 28 can be formed by conventional dip molding or vacuum molding.

It will be noted that, regardless of the configuration of the cell, each individual cell 58 is a four-finned collapsible or foldable cell. The foldable aspect of the cell is important in that it allows the cells to be spaced far enough apart to facilitate molding and to provide a reasonable amount surface area between the cells to permit solid bonding of top of the cushion to the bottom layer. The foldable four-fin design allows the cells to expand when inflated until they touch forming a continuous support surface.

Generally air cell layer 28 is dip molded from neoprene, as explained above. On the other hand, the cushions can be vacuum molded from a plastic material with the cells closer together than when dip molding and while avoiding thinning. Vacuum molding of plastic materials is simpler and less expensive than dip molding of neoprene. The cell geometry allows cells of any configuration to be vacuum molded, making individual seat cushions of differing cell configurations commercially feasible. The cell designs allow for pre-contoured seating surface that can be achieved by using different sizes and heights of cells.

The volume of air within the air cells 58 is adjustable and the cells are interconnected through flexible base 57 so that air flows from cell to cell. The cells are inflated by means of an inflation tube 60, which is in fluid communication with one of the interconnected cells 58. Tube 60 includes a manually operated open and close valve 62. When the air is introduced through tube 60 is flows from cell to cell so that the pressure in the cells is equalized. The air cells exert a generally uniform force on the buttocks and legs of a user. On the other hand, the cells of the array can be divided into individual inflation zones, each zone inflated to a desired pressure.

When the cushion is in use by a seated user, the air-filled cells deform under the weight load to equalize forces and conform closely to the shape of the user's body, thereby reducing the deformation of skin tissue. The shape of the air cells, for example a modified cruciform shape as shown in the figures, is selected to deform without any resistance other than the volume of air within. The height of the cells is adaptable to accommodate the differences in body contours.

Figure 10:
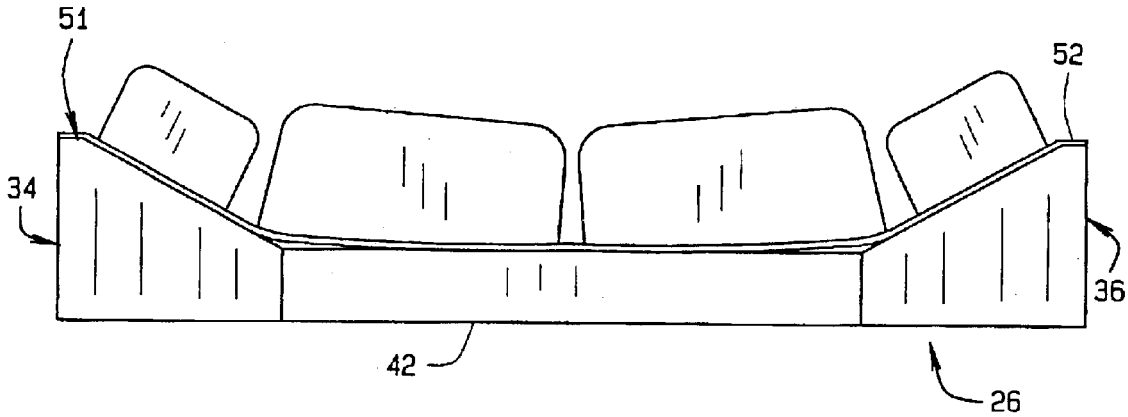
FIG. 10 is rear elevation view of the air cell layer positioned directly on the foam base showing the relationship of the layers in the assembled cushion.

In the illustrated embodiment, the air cells are not uniform in size and shape across the entire array, but instead are in some portions of the cushion tapered or reduced in height so that the tops of the air cells when disposed on the foam base are approximately equal in height to adjacent, upwardly projecting cells or portions of the foam base, such as the front bolster, as shown in FIG. 10. This arrangement of rows of cells of varied sizes can be seen in FIGS. 5 and 6, the air cells to meet the profile of an adjacent portion of foam.

For example, in one embodiment the first row 64 of air cells in the array, positioned along the front edge of the foam base, is reduced in height relative to the remaining cells in the array. This provides that the transition between the front row of air cells 64 and the front edge of the foam base is barely perceived by the user, and the front edge of the foam base adjacent to the modified air cells comes into contact with the user. More specifically, in the illustrated embodiment, the air cells 58 of the first row of air cells 64 that are disposed along the front edge of the foam base, beneath the thighs, have a reduced height and a wedged shape, as at 65. The air cells of such a geometry provide a smooth transition from the air cell layer to the downwardly angled facing edge 49 of the base foam structure to provide added comfort beneath the thighs, reducing or eliminating the user's sense of a bump or ridge.

Figure 5:
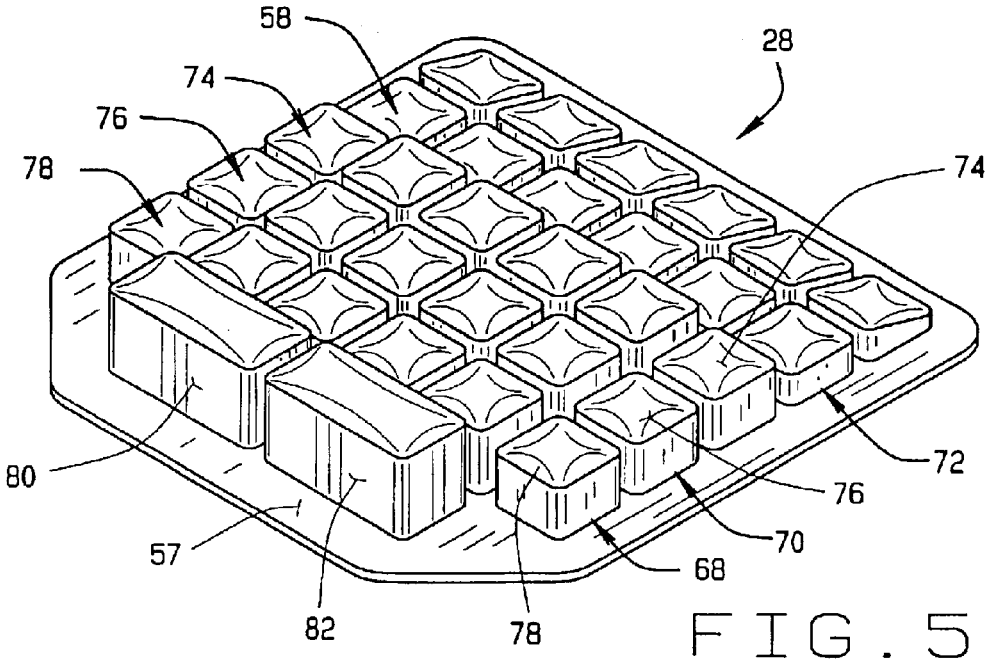
FIG. 5 is a perspective view of the layer of air cells.
Figure 6:
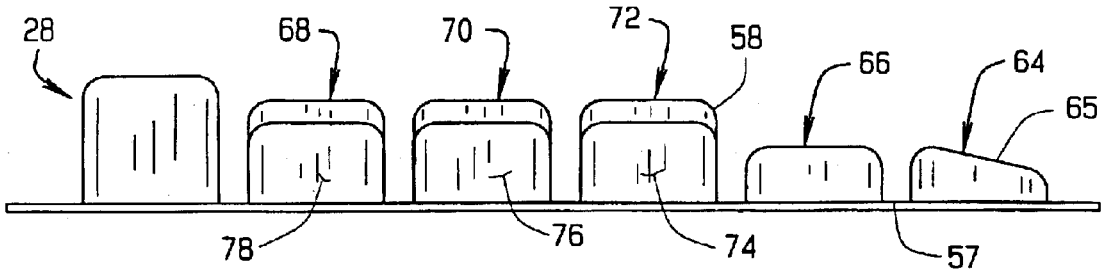
FIG. 6 is a side elevational view of the air cell layer.
Figure 7:
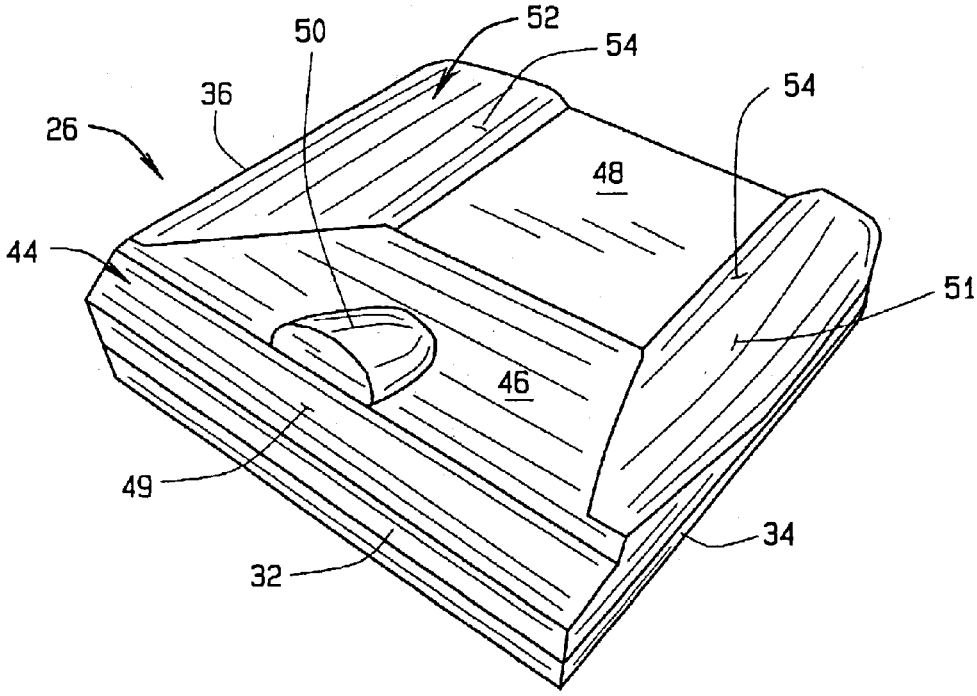
FIG. 7 is a front perspective view of a foam base of the multi-layer cushion with a pommel on the front bolster of the foam base.
Figure 8:
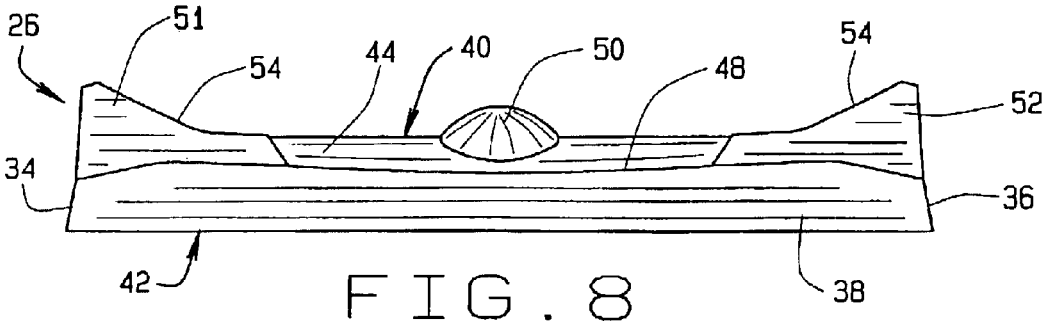
FIG. 8 is a rear elevational view of the foam base.

A second row 66 of cells 58 of reduced height positioned adjacent the first row 64 forms a transition area between the front bolster and first row of cells and the next three rows of cells, 68, 70, 72. Referring to FIG. 5, the three rows 68, 70, and 72 are comprised of cells that form the main ischial support area of the cushion. The main ischial support area is designed to be positioned under the ischial area of a user seated on cushion 10 to relieve pressure on the ischial area and reduce the risk of tissue break down and pressure sores. The end cells 74, 76, 78 of the respective three rows 68, 70 and 72 are of a lesser vertical height than the other cells in the rows.

Air cell layer 28 includes a pair of rear cells 80, 82 along the rear edge of the air cell layer. Cells 80 and 82 are generally elongated rectangles and can be greater in vertical height than the other cells of the array. These larger cells form a rear bolster when the air cell layer is positioned on the base.

The modified air cells more closely match the profile of the adjacent portions of the foam base, thus reducing the feel of the transition between the air cell layer and the foam base. Further, the array of air cells can include a gradual successive change in the height or profile of each successive row of air cells, to more gradually change the profile of the cushion. As shown in FIG. 10, the shorter end cells 74, 76 and 78 are positioned along the length of the side bolsters. The rear cells 80 and 82, when positioned on the support area 48 of the base, assume the same approximate height as the side bolsters 51 and 52. The shorter end cells and rear cells form a contiguous surface with the air cell layer is positioned on the base when the air cell layer is positioned on the base. That is, as can be seen in FIG. 9, the cells comprising the array of cells assume generally the same vertical height when the air cell layer is positioned on the base.

The unique design of the front transition rows of cells already has been discussed. It will be appreciated that the cell size and arrangement of cells in the inflatable cushions illustrated are one exemplary shown to work well in the instant invention. However, the various numbers of cells, sizes of cells and arrangements of cells in rows may be varied to suit the needs of a user. Any cushion layer design is intended to be encompassed by the scope of the invention. Furthermore, the multi-layer cushion can be constructed so that the upper deformable layer comprises a material other than an air cell cushion 28. For example, the upper layer could be comprised of cells filled with elastomeric gel. The layer could be configured form a gelatinous cushioning media or gelatinous elastomer formed in a honeycomb arrangement or in columns or any other material of resilient, shock-absorbing deformable material that can be used to produce a deformable yet resilient layer that fits appropriately with the base and cooperates with the base to provide the desired smooth translational areas between the upper layer and the base.

Figure 3:
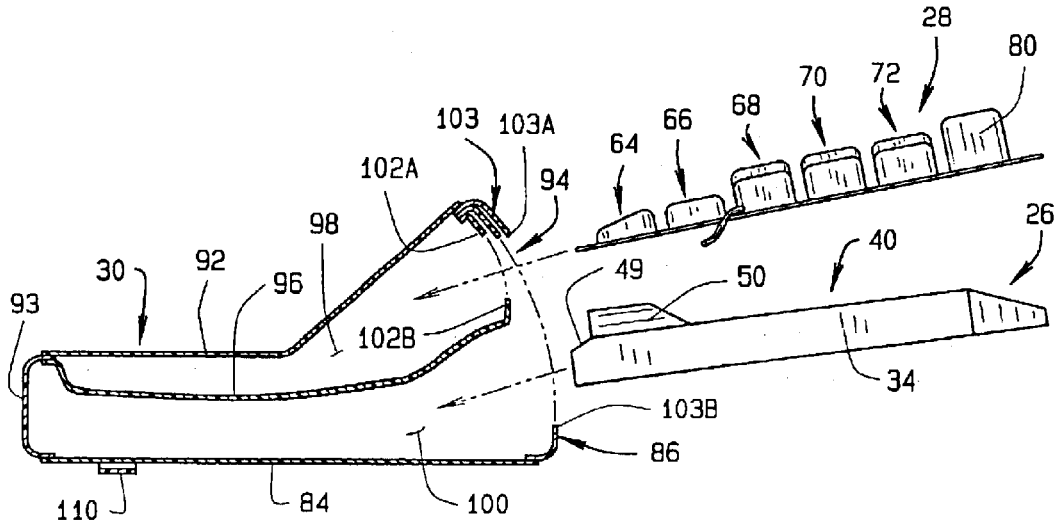
FIG. 3 is a side elevational view of the disassembled cushion and cover, the cover shown in cross section.

An outer cover 30 fits over the air cell layer 28 and base 26 and holds the two layers in place relative to one another. One embodiment of a cover design is shown in FIGS. 2 and 3. The cover 30 is fabricated from any suitable fabric such as nylon or the like, rubber or rubberized material or foam, or a composite of different fabric or rubberized materials. Cover 26 has durable bottom panel 84 comprising a flexible, wear resistant, non-skid material such as vinyl. The cover includes a rear panel 86, a first side panel 88 and opposite side panel 90 (FIG. 1) and a top panel 92 and front panel 93. In a preferred embodiment, the top panel section is constructed from an elastic fabric material that can stretch in multiple directions. The respective side panels are constructed from a polymer material, such as nylon or the like. The recited panels define an inner compartment 94.

The inner compartment 94 is subdivided by a flexible cloth or polymer middle panel 96 that divides the cover into an upper compartment or pocket 98 and a lower compartment or pocket 100. There is an inner zipper 102 comprised of opposed, interengaging toothed tracks 102A, 102B that attaches the edge of the middle panel 96 to the inside of the upper panel so as to close the upper compartment. A main outer zipper 103 comprised of opposed interengaging toothed tracks 103A and 103B extends from side panel to side panel and transects the rear panel. The main zipper 103, when closed, functions to close the lower compartment 100 resulting in the two layers 26 and 28 being tightly secured inside the cover, each in its own compartment.

Any type of known securing means, such as zippers, hook-and-loop type fabric strips, hooks, snaps or the like can be used to close the cover and retain the air cell layer in its pocket and base in its pocket. This novel arrangement keeps the upper layer appropriately positioned on the base, and prevents the upper air cell cushion layer from being displaced during user movement or other movement of the cushion.

There is an opening 104 in one side panel covered by a flap 106. The opening allows the air tube 60 to protrude out of the cover. The flap 106 and the side panel have opposed segments of hook and loop fastener 108A, 108B.

An opening or hole (not shown) in the middle panel 96 near opening 104 allows the air filling tube 60 to protrude out of compartment 98 and through the cover at opening 104. Tube 60 can be pressed against the side panel and the flap 106 secured closed to keep the valve out of the way. The bottom panel 84 of the cover can have attachment means 110, such as hook and loop fastener, to facilitate attachment of the cushion 10 to a wheelchair seat, vehicle seat, chair or other seating device. The bottom can include a strap that can be fastened upon itself by hook and loop fastener, such as Velcro® to secure the cushion to a seat.

The combination of the base layer with bolsters and upper layer of soft or resilient material such as an air cell cushion or gel type cushion provides a cushion that reduces and redistributes pressure from restricted pressure points in the ischial and trochanter regions, and provides the user with a sense of postural stability and security, while also reducing discomfort and annoyance due to the transition between air-filled cells and the foam base. Furthermore, the cover functions to provide an aesthetically pleasing seating surface, protect the cushion and base and, importantly, keep the upper layer in proper position on the base layer so to reap full advantage of the cell and bolster arrangement that eliminates uncomfortable transition areas and unwanted pressure to increase comfort and safety in use.

What is claimed is:

1. A seat cushion comprising:

a supportive base having a front bolster with an inwardly angled surface, a first lateral bolster extending along substantially the entire length of a first side of the base, and a second lateral bolster extending substantially along an opposite side of the base, a cushioning layer positioned on the base, said cushioning layer comprised of a flexible base having a front edge, opposed side edges and a rear edge with an array of individual air cells on the flexible base, each said air cell comprised of a substantially rectangular body and a top wall, the array of individual air cells arranged in a plurality of rows of linearly aligned air cells, at least one of said rows of air cells positioned along the front edge of the cushioning layer flexible base and comprising individual air cells having a top wall configured to form a transition area between the inwardly angled surface of the front bolster and the cushioning layer; and a cover enclosing the base and the cushioning layer comprising a first compartment for containment of the base and a second compartment for containment of the cushioning layer, said second recited compartment functioning to position and maintain the cushioning layer on the base.

2. The seat cushion of claim 1 wherein the individual air cells of said at least one row positioned along the front edge of the cushioning layer each have a top wall angled downwardly toward the front bolster.

3. The seat cushion of claim 1 wherein the individual cells of said at least one row being of a lesser vertical height than the individual air cells of a row adjacent to said at least one row of individual air cells.

4. The seat cushion of claim 1 wherein the said cushioning layer further comprises a row of individual air cells along the rear edge of the flexible base of the cushioning layer to form a rear bolster.

5. The seat cushion of claim 4 wherein said row of individual air cells along the rear edge of the flexible base of the cushioning layer is further comprised of two individual air cells.

6. The seat cushion of claim 4 wherein the individual air cells along the rear edge of the flexible base of the cushioning layer has a greater surface area than any other individual air cell in the array of air cells.

7. The seat cushion of claim 1 wherein said cushioning layer includes a row of cells along the first side edge of the flexible base and a row of cells along the second side edge of the flexible base, said row of cells along said first side edge of the flexible base shaped and positioned to form a transition area between the first lateral bolster and the cushioning layer and said row of cells along said second side edge of the flexible base shaped and positioned to form a transition area between the second lateral bolster and the cushioning layer.

8. The seat cushion of claim 1 wherein the cushioning layer is molded from neoprene.

9. The seat cushion of claim 1 wherein the supportive base is formed from a polyurethane foam.

10. A multi-layer seat cushion comprising;

a supportive base having a front bolster, a first lateral bolster and a second lateral bolster;

a cushioning layer positioned on the base within the recited bolsters; and a cover comprising a first compartment enclosing the supportive base and a second compartment enclosing the cushioning layer, whereby the cover maintains the cushioning layer in position on the supportive base within the recited bolsters.

11. The multi-layer seat cushion of claim 10 wherein said cushioning layer comprises a flexible base having a front edge, opposed side edges and a rear edge with an array of individual air cells on the flexible base, each said air cell comprised of a substantially rectangular body and a top wall, the array of individual air cells arranged in a plurality of rows of linearly aligned air cells, at least one of said rows of air cells positioned along the front edge of the cushioning layer flexible base comprising air cells having an angled top wall configured to form a transition area between the front bolster and the cushioning layer.

12. The multi-layer seat cushion of claim 11 wherein the said cushioning layer further comprises a row of individual air cells along the rear edge of the flexible base to form a rear bolster.

13. The multi-layer seat cushion of claim 10 wherein said cushioning layer further comprises a gel-filled cellular cushion.

14. The multi-layer seat cushion of claim 10 wherein the cushioning layer is molded from a plastic.

15. The multi-layer seat cushion of claim 10 wherein said cushioning layer further comprises a gelatinous elastomer.

16. The multi-layer seat cushion of claim 15 wherein said cushioning layer further comprises a gelatinous elastomer formed in a honeycomb arrangement.

17. The multi-layer seat cushion of claim 15 wherein said cushioning layer further comprises gelatinous elastomer formed into shock absorbing columns.

18. The multi-layer seat cushion of claim 10 wherein said cover further comprises a top panel, a first side panel, a second side panel, a front panel, a rear panel, and bottom panel, said recited panels defining an inner compartment, and a middle panel within said inner compartment dividing said inner compartment into said first and second compartments.

19. The multi-layer seat cushion of claim 18 wherein said top panel is comprised of an elastic material.

20. The multi-layer seat cushion of claim 18 wherein said bottom panel is comprised of a wear resistant, non-skid material.

21. The multi-layer seat cushion of claim 10 having a first closure apparatus for closing said first compartment.

22. The multi-layer seat cushion of claim 10 having a closure apparatus for closing said second compartment.

23. The multi-layer seat cushion of claim 21 or 22 wherein said closure apparatus is a zipper.

24. The multi-layer seat cushion of claim 21 wherein said closure apparatus is located on a back panel of said cover.

25. The multi-layer seat cushion of claim 10 wherein said cushioning layer further comprises an air fill tube and said cover further comprises an opening therein for egress of said air fill tube.

26. A cover for use with a seat cushion having at least two cushioning layers, comprising a top panel, a first side panel, a second side panel, a front panel, a rear panel, and bottom panel, said recited panels defining a inner compartment, and a middle panel within said inner compartment dividing said inner compartment into a first pocket to contain one of said at least two cushioning layers and second socket in vertical alignment with the first pocket to contain the other of said at least two cushioning layers whereby the cover maintains the at least two layers in vertical alignment;

means on said bottom panel for attaching the seat cushion to a seat of a wheelchair.

27. The cover of claim 26 having a first closure apparatus far closing said first pocket.

28. The cover of claim 26 having a closure apparatus for closing said second pocket.

29. The cover of claim 26 wherein said top panel is comprised of an elastic material.

30. The cover of claim 26 wherein said bottom panel is comprised of a wear resistant, non-skid material.

31. An air cell cushion for placement on a support surface to provide comfortable seating for a user seated on the cushion, comprising:

a flexible base for positioning on the support surface; and an array of individual air cells extending upwardly from said flexible base, each said air cell having a front wall, a back wall, a first side wall , a second side wall and a top wall, said array of cells arranged in rows across the flexible base and comprising a plurality of generally centrally positioned rows forming a seating area for positioning under the ischial area of a user seated on the cushion, and at least one row of cells along a front edge of the base, each cell comprising the row along the front edge configured with the back wall having a vertical height greater than the vertical height of the front wall so that the top wall is downwardly angled from the back wall to the front wall and positioned to provide comfortable transition areas between the front of the seating area and the support surface.

32. The multi-layer cushion of claim 31 wherein the individual air cells have four fins.

33. The air cell cushion of claim 31 wherein the plurality of generally centrally positioned rows further comprises three generally centrally positioned rows.

34. The air cell cushion of claim 33 wherein the cells comprising the three generally centrally positioned rows are of a uniform configuration and have a uniform vertical height.

35. The air cell cushion of claim 34 wherein said rows of cells around the perimeter of the base further comprises a row of cells along a rear edge of the flexible base have a rectangular configuration to form a rear bolster.

36. The air cell cushion of claim 34 wherein in said rows of cells around the perimeter of the base further comprises a row of cells on a first side edge of the base and a row of cells on a second side edge of the base, said last two recited rows of cells having a vertical height less than the vertical height of the cells in the three generally centrally positioned rows to form transition areas between the centrally positioned rows of cells and the support surface.

37. The air cell cushion of claim 34 wherein in said rows of cells around the perimeter of the base further comprises at least one row of cells on a front edge of the base said at least one row of cells having a vertical height less than the vertical height of the cells in the three generally centrally positioned rows, and a top surface angled toward the front edge of the base to form a transition area between the centrally positioned rows of cells and the support surface.

38. The air cell cushion of claim 37 further comprising a row of cells positioned between the at least one row of cells on the front edge of the base and the three generally centrally positioned rows having a vertical height less than the vertical height of the cells in the three generally centrally positioned rows to form a transition area between the centrally positioned rows of cells and the at least one row of cells on the front edge of the base.

39. An air cell cushion for placement on a support surface to provide comfortable seating for a user seated on the cushion, comprising:

a flexible base having a front edge, a rear edge, a first side edge and a second side edge;

an array of individual upstanding air cells on the base arranged in rows on the base, the rows on the base further comprising a plurality of rows positioned substantially centrally on the base to form a seating area for positioning under the ischial area of the user, each individual cell in the seating area having the substantially the same configuration and vertical height, and the rows of cells further comprising a row of cells along each of the recited edges of the flexible base;

wherein the row of cells along the rear edge of the base form a bolster;

wherein the row of cells along the first side edge of the base is comprised of individual cells having a vertical height less than the vertical height of the cells in the seating area to form a transition area between the seating area adjacent that side edge and the support surface;

wherein the row of cells along the second side edge of the base is comprised of individual cells having a vertical height less than the vertical height of the cells in the seating area to form a transition area between the seating area adjacent that side edge and the support surface; and wherein the row of cells along the front edge of the base is comprised of individual cells having a wedged shaped configuration and a vertical height less than the vertical height of the cells in the seating area to form a transition area between the seating area adjacent the front edge and the support surface.

40. The cushion of claim 39 wherein the plurality of rows positioned substantially centrally on the base to form a seating area for positioning under the ischial area of the user further comprise three rows.

41. The cushion of claim 39 molded from a plastic material.

42. An air cell cushion for placement on a support surface to provide comfortable seating for a user seated on the cushion, comprising:

a flexible base for positioning on the support surface; and an array of individual air cells extending upwardly from said flexible base, said array of cells arranged in rows across the flexible base and comprising three generally centrally positioned rows comprising cells of a uniform configuration and uniform height forming a seating area for positioning under the ischial area of a user seated on the cushion, and a row of cells on a first side edge of the base end a row of cells on a second side edge of the base, said last two recited rows of cells having a vertical height less than the vertical height of the cells in the three generally centrally positioned rows to form transition areas between the centrally positioned rows of cells and the support surface.

* * * * *